US007059936B2

(12) United States Patent
Prasad

(10) Patent No.: US 7,059,936 B2
(45) Date of Patent: Jun. 13, 2006

(54) LOW SURFACE ENERGY CMP PAD

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 10/807,079

(22) Filed: Mar. 23, 2004

(65) Prior Publication Data

US 2005/0215179 A1 Sep. 29, 2005

(51) Int. Cl.
*B24D 11/00* (2006.01)

(52) U.S. Cl. ..... 451/8; 451/526

(58) Field of Classification Search ..... 451/8, 451/41, 527, 528, 530, 533, 537, 538, 526
See application file for complete search history.

(56) References Cited

U.S. PATENT DOCUMENTS

| | | | | |
|---|---|---|---|---|
| 5,489,233 | A | 2/1996 | Cook et al. | |
| 5,990,012 | A | 11/1999 | Robinson et al. | |
| 6,022,264 | A | 2/2000 | Cook et al. | |
| 6,022,268 | A | 2/2000 | Roberts et al. | |
| 6,069,080 | A | 5/2000 | James et al. | |
| 6,106,754 | A | 8/2000 | Cook et al. | |
| 6,206,769 | B1 | 3/2001 | Walker | |
| 6,217,434 | B1 | 4/2001 | Roberts et al. | |
| 6,277,015 | B1 | 8/2001 | Robinson et al. | |
| 6,585,574 | B1 | 7/2003 | Lombardo et al. | |
| 6,884,156 | B1 * | 4/2005 | Prasad et al. | 451/533 |
| 6,911,059 | B1 * | 6/2005 | Geyer | 51/298 |
| 2002/0016139 | A1 * | 2/2002 | Hirokawa et al. | 451/54 |
| 2002/0172655 | A1 * | 11/2002 | Hiwatashi et al. | 424/70.16 |
| 2003/0129931 | A1 | 7/2003 | Konno et al. | |
| 2004/0023597 | A1 * | 2/2004 | Truong | 451/41 |
| 2004/0092102 | A1 * | 5/2004 | Li et al. | 438/689 |
| 2004/0116054 | A1 * | 6/2004 | Geyer | 451/285 |

FOREIGN PATENT DOCUMENTS

| | | | |
|---|---|---|---|
| JP | 2003 128910 | A | 5/2003 |
| JP | 2005 068175 | A | 3/2005 |
| JP | 2005 129644 | A | 5/2005 |
| WO | WO 98/45087 | | 10/1998 |
| WO | WO 99/24218 | | 5/1999 |
| WO | WO 03/068883 | A | 8/2003 |

* cited by examiner

*Primary Examiner*—Jacob K. Ackun, Jr.

(57) ABSTRACT

The invention provides a polishing pad substrate comprising a copolymer, wherein the copolymer has at least one hydrophilic repeat unit and at least one hydrophobic repeat unit. The invention also provides a polishing pad substrate comprising a polymer, wherein the polymer is a modified polymer having at least one hydrophilic unit and at least one hydrophobic unit attached to the polymer chain. The invention further provides a method of polishing a workpiece comprising (i) providing a workpiece to be polished, (ii) contacting the workpiece with a chemical-mechanical polishing system comprising the polishing pad substrate of the invention, and (iii) abrading at least a portion of the surface of the workpiece with the polishing system to polish the workpiece.

40 Claims, No Drawings

LOW SURFACE ENERGY CMP PAD

FIELD OF THE INVENTION

This invention pertains to a polishing pad suitable for use in chemical-mechanical polishing systems.

BACKGROUND OF THE INVENTION

Chemical-mechanical polishing ("CMP") processes are used in the manufacturing of microelectronic devices to form flat surfaces on semiconductor wafers, field emission displays, and many other microelectronic workpieces. For example, the manufacture of semiconductor devices generally involves the formation of various process layers, selective removal or patterning of portions of those layers, and deposition of yet additional process layers above the surface of a semiconducting workpiece to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

Polishing pads used in chemical-mechanical polishing processes are manufactured using both soft and rigid pad materials, which include polymer-impregnated fabrics, microporous films, cellular polymer foams, non-porous polymer sheets, and sintered thermoplastic particles. A pad containing a polyurethane resin impregnated into a polyester non-woven fabric is illustrative of a polymer-impregnated fabric polishing pad. Microporous polishing pads include microporous urethane films coated onto a base material, which is often an impregnated fabric pad. These polishing pads are closed cell, porous films. Cellular polymer foam polishing pads contain a closed cell structure that is randomly and uniformly distributed in all three dimensions. Non-porous polymer sheet polishing pads include a polishing surface made from solid polymer sheets, which have no intrinsic ability to transport slurry particles (see, for example, U.S. Pat. No. 5,489,233). These solid polishing pads are externally modified with large and/or small grooves that are cut into the surface of the pad purportedly to provide channels for the passage of slurry during chemical-mechanical polishing. Such a non-porous polymer polishing pad is disclosed in U.S. Pat. No. 6,203,407, wherein the polishing surface of the polishing pad comprises grooves that are oriented in a way that purportedly improves selectivity in the chemical-mechanical polishing. Sintered polishing pads comprising a porous open-celled structure can be prepared from thermoplastic polymer resins. For example, U.S. Pat. Nos. 6,062,968 and 6,126,532 disclose polishing pads with open-celled, microporous substrates, produced by sintering thermoplastic resins.

Although several of the above-described polishing pads are suitable for their intended purpose, a need remains for other polishing pads that provide effective planarization, particularly in workpieces polished by chemical-mechanical polishing. In addition, there is a need for polishing pads having lower surface energy, particularly for use with hydrophobic polishing compositions.

The invention provides such a polishing pad. These and other advantages of the invention, as well as additional inventive features, will be apparent from the description of the invention provided herein.

BRIEF SUMMARY OF THE INVENTION

The invention provides a polishing pad substrate comprising a copolymer having at least one hydrophilic repeat unit and at least one hydrophobic repeat unit. The invention also provides a polishing pad substrate comprising a polymer having at least one hydrophilic unit and at least one hydrophobic unit attached to the polymer chain. The invention further provides a method of polishing a workpiece comprising (i) providing a workpiece to be polished, (ii) contacting the workpiece with a chemical-mechanical polishing system comprising the polishing pad of the invention, and (iii) abrading at least a portion of the surface of the workpiece with the polishing system to polish the workpiece.

DETAILED DESCRIPTION OF THE INVENTION

A polishing pad substrate comprising a copolymer, wherein the copolymer has at least one hydrophilic repeat unit and at least one hydrophobic repeat unit. The term "copolymer" indicates a polymer chain containing more than one repeat unit. The term "hydrophilic repeat unit" is defined as the repeating segment of the copolymer such that a homopolymer composed solely of such a hydrophilic repeat unit would have a surface energy of more than 34 mN/m. The term "hydrophobic repeat unit" is defined as the repeating segment of the copolymer such that a homopolymer composed solely of such a hydrophobic repeat unit would have a surface energy of 34 mN/m or less.

For example, the copolymer can have the following structure:

$$(X^1)_a—(P)_y—(X^2)_b—(X^3)_c—(N)_z—(X^4)_d$$

wherein $X^1$, $X^2$, $X^3$ and $X^4$ are the same or different and are either a hydrophilic repeat unit or a hydrophobic repeat unit, P is a hydrophilic repeat unit, N is a hydrophobic repeat unit, and a, b, c, d, y, and z are integers selected from 0 to 100,000 inclusive.

Alternatively, the polishing pad substrate can comprise a polymer, wherein the polymer has at least one hydrophilic unit and at least one hydrophobic unit attached to the polymer chain. The hydrophilic units or hydrophobic units that are covalently bonded to the polymer chain preferably have different structures from the repeat units of the polymer chain. The at least one hydrophilic unit and at least one hydrophobic unit can be attached to a terminal repeat unit or a non-terminal repeat unit in the polymer chain. The term "hydrophilic unit" is defined as a molecule attached to the polymer chain such that a substance composed solely of such a molecule would have a surface energy more than 34 mN/m. The term "hydrophobic unit" is defined as a molecule attached to the polymer chain such that a substance composed solely of such a molecule would have a surface energy of 34 mN/m or less.

For example, the polymer having at least one hydrophilic unit and at least one hydrophobic unit attached to the polymer chain can be described by the following structures:

$$U—(X^1)_a—(X^2)_b—(X^3)_c—V$$

wherein (i) $X^1$, $X^2$, and $X^3$ have the meanings given above, (ii) U is a hydrophilic unit, (iii) V is a hydrophobic unit, and (iv) a, b, and c are integers selected from 0 to 100,000 inclusive, or $$X^1—(X^2)_a—(X^3)_b—(X^4)_c—(X^5)_d—(X^6)_e—X^7$$
$$\qquad\quad | \qquad\quad | \qquad\quad | \qquad\quad | \qquad\quad |$$
$$\qquad\quad R^1 \qquad\quad U \qquad\quad R^2 \qquad\quad V \qquad\quad R^3$$

wherein (i) $X^1$, $X^2$, $X^3$, $X^4$, $X^5$, $X^6$, and $X^7$ are the same or different and are either a hydrophilic repeat unit or a hydrophobic repeat unit, (ii) $R^1$, $R^2$, and $R^3$ are the same or different and are either a hydrophilic unit or a hydrophobic unit (iii) U is a hydrophilic unit, (iv) V is a hydrophobic unit, and (v) a, b, c, d, and e are integers selected from 0 to 100,000 inclusive.

The polymer used in the polishing pad substrate of the invention can be any suitable polymer and can be prepared from any suitable polymer. For example, suitable polymers can be thermoplastic polymers or thermoset polymers selected from the group consisting of polyurethanes, polyolefins, polyvinylalcohols, polyvinylacetates, polycarbonates, polyacrylic acids, polyacrylamides, polyethylenes, polypropylenes, nylons, fluorocarbons, polyesters, polyethers, polyamides, polyimides, polytetrafluoroethylenes, polyetheretherketones, copolymers thereof, and mixtures thereof.

The hydrophilic repeat unit and hydrophilic unit can be any suitable such units. For example, the hydrophilic repeat unit and hydrophilic unit can be selected from the group consisting of esters, ethers, acrylic acids, acrylamides, amides, imides, vinylalcohols, vinylacetates, acrylates, methacrylates, sulfones, urethanes, vinylchlorides, etheretherketones, carbonates, and oligomers and combinations thereof.

The hydrophobic repeat unit and hydrophobic unit can be any suitable such units. For example, the hydrophobic repeat unit and hydrophobic unit can be selected from the group consisting of fluorocarbons, tetrafluoroethylenes, vinylfluorides, siloxanes, dimethylsiloxanes, butadiene, ethylene, olefins, styrene, propylene, and oligomers and combinations thereof.

The polishing pad substrate of the invention can have any suitable surface energy, desirably a surface energy of about 34 mN/m or less (e.g., about 30 mN/m or less, about 26 mN/m or less, or about 22 mN/m or less). The surface energy is the lowest surface energy a liquid composition can have while still exhibiting a contact angle with the surface that is greater than zero. Therefore, polymers, copolymers, or modified polymers with surface energies of about 34 mN/m or less are more readily wet by liquid compositions (such as polishing compositions) that have surface energies of about 40 mN/m or less (e.g., about 34 mN/m or less, about 28 mN/m or less, or about 22 mN/m or less).

The polishing pad substrate of the invention can be a solid, non-porous polishing pad substrate. For example, the polishing pad substrate can have a density of about 90% or more of the maximum theoretical density of the copolymer or of the modified polymer (e.g., about 93% or more, about 95% or more, or about 98% or more).

Alternatively, the polishing pad substrate of the invention can be a porous polishing pad substrate. For example, the polishing pad substrate can have a density of about 70% or less of the maximum theoretical density of the copolymer or of the modified polymer (e.g., about 60% or less, about 50% or less, or about 40% or less). The porous polishing pad substrate can have any suitable void volume. For example, the polishing pad substrate can have a void volume of about 75% or less (e.g., about 70% or less, about 60% or less, or about 50% or less).

The polishing pad substrate of the invention can be used alone, or optionally can be mated to another polishing pad substrate. When two polishing pad substrates are mated, the polishing pad substrate intended to contact the workpiece to be polished serves as the polishing layer, while the other polishing pad substrate serves as the subpad. For example, the polishing pad substrate of the invention can be a subpad that is mated to a conventional polishing pad having a polishing surface, wherein the conventional polishing pad serves as the polishing layer. Alternatively, the polishing pad substrate of the invention can comprise a polishing surface, and serve as the polishing layer, and can be mated to a conventional polishing pad that serves as a subpad. Suitable polishing pads for use as the polishing layer in combination with a polishing pad substrate of the invention include solid or porous polyurethane pads, many of which are well known in the art. Suitable subpads include polyurethane foam subpads, impregnated felt subpads, microporous polyurethane subpads, and sintered urethane subpads. The polishing layer and/or the subpad optionally comprises grooves, channels, hollow sections, windows, apertures, and the like. The subpad can be affixed to the polishing layer by any suitable means. For example, the polishing layer and subpad can be affixed through adhesives or can be attached via welding or similar technique. Typically, an intermediate backing layer such as a polyethyleneterephthalate film is disposed between the polishing layer and the subpad. When the polishing pad substrate of the invention is mated to a conventional polishing pad, the composite polishing pad also is considered a polishing pad substrate of the invention.

The polishing layer can be modified by buffing or conditioning, such as by moving the pad against an abrasive surface. The preferred abrasive surface for conditioning is a disk which is preferably metal and which is preferably embedded with diamonds of a size in the range of 1 μm to 0.5 mm. Optionally, conditioning can be conducted in the presence of a conditioning fluid, preferably a water-based fluid containing abrasive particles.

The polishing layer optionally further comprises grooves, channels, and/or perforations. Such features can facilitate the lateral transport of a polishing composition across the surface of the polishing layer. The grooves, channels, and/or perforations can be in any suitable pattern and can have any suitable depth and width. The polishing pad substrate can have two or more different groove patterns, for example a combination of large grooves and small grooves as described in U.S. Pat. No. 5,489,233. The grooves can be in the form of linear grooves, slanted grooves, concentric grooves, spiral or circular grooves, or XY crosshatch pattern, and can be continuous or non-continuous in connectivity.

The polishing pad substrate of the invention optionally further comprises one or more apertures, transparent regions, or translucent regions (e.g., windows as described in U.S. Pat. No. 5,893,796). The inclusion of such apertures or translucent regions (i.e., optically transmissive regions) is desirable when the polishing pad substrate is to be used in conjunction with an in situ CMP process monitoring technique. The aperture can have any suitable shape and may be used in combination with drainage channels for minimizing or eliminating excess polishing composition on the polishing surface. The optically transmissive region or window can be any suitable window, many of which are known in the art. For example, the optically transmissive region can comprise a glass or polymer-based plug that is inserted in an aperture of the polishing pad or may comprise the same polymeric material used in the remainder of the polishing pad. For example, the optically transmissive region can optionally comprise a copolymer having at least one hydrophilic repeat unit and at least one hydrophobic repeat unit, or the optically transmissive region can optionally comprise a polymer having at least one hydrophilic unit and at least one hydrophobic unit attached to the polymer chain. Typically, the optically transmissive region has a light transmittance of about 10% or more (e.g., about 20% or more, or about 30% or more) at one or more wavelengths between from about 190 nm to about 10,000 nm (e.g., from about 190 nm to about 3500 nm, from about 200 nm to about 1000 nm, or from about 200 nm to about 780 nm).

The optically transmissive region can have any suitable structure (e.g., crystallinity), density, and porosity. For example, the optically transmissive region can be solid or porous (e.g., microporous or nanoporous having an average pore size of less than 1 μm). Preferably, the optically transmissive region is solid or is nearly solid (e.g., has a void volume of about 3% or less). The optically transmissive region optionally further comprises particles selected from polymer particles, inorganic particles, and combinations thereof. The optically transmissive region optionally contains pores.

The optically transmissive region optionally further comprises a dye, which enables the polishing pad substrate material to selectively transmit light of a particular wavelength(s). The dye acts to filter out undesired wavelengths of light (e.g., background light) and thus improves the signal to noise ratio of detection. The optically transmissive region can comprise any suitable dye or may comprise a combination of dyes. Suitable dyes include polymethine dyes, di- and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 633 nm, the dye preferably is a red dye, which is capable of transmitting light having a wavelength of about 633 nm.

The polishing pad substrate of the invention optionally contains particles, e.g., particles that are incorporated into the substrate. The particles can be abrasive particles, polymer particles, composite particles (e.g., encapsulated particles), organic particles, inorganic particles, clarifying particles, water-soluble particles, and mixtures thereof. The polymer particles, composite particles, organic particles, inorganic particles, clarifying particles, and water-soluble particles also may be abrasive, or may be non-abrasive, in nature.

The abrasive particles can be of any suitable material. For example, the abrasive particles can comprise a metal oxide, such as a metal oxide selected from the group consisting of alumina, silica, titania, ceria, zirconia, germania, magnesia, co-formed products thereof, and combinations thereof, or a silicon carbide, boron nitride, diamond, garnet, or ceramic abrasive material. The abrasive particles can be hybrids of metal oxides and ceramics or hybrids of inorganic and organic materials. The particles also can be polymer particles, many of which are described in U.S. Pat. No. 5,314,512, such as polystyrene particles, polymethylmethacrylate particles, liquid crystalline polymers (LCP, e.g., aromatic copolyesters containing naphthalene units), polyetheretherketones (PEEK's), particulate thermoplastic polymers (e.g., particulate thermoplastic polyurethane), particulate cross-linked polymers (e.g., particulate cross-linked polyurethane or polyepoxide), or a combination thereof. The composite particles can be any suitable particle containing a core and an outer coating. For example, the composite particles can contain a solid core (e.g., a metal oxide, metal, ceramic, or polymer) and a polymeric shell (e.g., polyurethane, nylon, or polyethylene). The clarifying particles can be phyllosilicates, (e.g., micas such as fluorinated micas, and clays such as talc, kaolinite, montmorillonite, hectorite), glass fibers, glass beads, diamond particles, carbon fibers, and the like.

The polishing pad substrate of the invention can be produced by any suitable means known in the art. For example, the polishing pad substrate can be produced by sintering powder compacts comprising a copolymer having at least one hydrophilic repeat unit and at least one hydrophobic repeat unit or by sintering powder compacts comprising a polymer having at least one hydrophobic unit and at least one hydrophilic unit attached to the polymer chain. Alternatively, the polishing pad substrate of the invention can be produced by extruding the aforesaid copolymer or the aforesaid polymer. The extruded copolymer or polymer can optionally be modified to increase the porosity or void volume.

The polishing pad substrate of the invention is particularly suited for use in conjunction with a chemical-mechanical polishing (CMP) apparatus. Typically, the apparatus comprises (a) a platen, which, when in use, is in motion and has a velocity that results from orbital, linear, or circular motion, (b) a polishing pad substrate of the invention in contact with the platen and moving with the platen when in motion, and (c) a carrier that holds a workpiece to be polished by contacting and moving relative to the surface of the polishing pad intended to contact a workpiece to be polished. The polishing of the workpiece takes place by the workpiece being placed in contact with the polishing pad substrate and then the polishing pad substrate moving relative to the workpiece, typically with a polishing composition therebetween, so as to abrade at least a portion of the workpiece to polish the workpiece. The CMP apparatus can be any suitable CMP apparatus, many of which are known in the art. The polishing pad substrate of the invention also can be used with linear polishing tools.

Suitable workpieces that can be polished with the polishing pad substrate of the invention include memory storage devices, glass substrates, memory or rigid disks, metals (e.g., noble metals), magnetic heads, inter-layer dielectric (ILD) layers, polymeric films (e.g., organic polymers), low and high dielectric constant films, ferroelectrics, micro-electro-mechanical systems (MEMS), semiconductor wafers, field emission displays, and other microelectronic workpieces, especially microelectronic workpieces comprising insulating layers (e.g., metal oxide, silicon nitride, or low dielectric materials) and/or metal-containing layers (e.g., copper, tantalum, tungsten, aluminum, nickel, titanium, platinum, ruthenium, rhodium, iridium, silver, gold, alloys thereof, and mixtures thereof). The term "memory or rigid disk" refers to any magnetic disk, hard disk, rigid disk, or memory disk for retaining information in electromagnetic form. Memory or rigid disks typically have a surface that comprises nickel-phosphorus, but the surface can comprise any other suitable material. Suitable metal oxide insulating layers include, for example, alumina, silica, titania, ceria, zirconia, germania, magnesia, and combinations thereof. In addition, the workpiece can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), metal silicides (e.g., tungsten silicide and titanium silicide), nickel-phosphorus, alumino-borosilicate, borosilicate glass, phosphosilicate glass (PSG), borophosphosilicate glass (BPSG), silicon/germanium alloys, and silicon/germanium/carbon alloys. The workpiece also can comprise, consist essentially of, or consist of any suitable semiconductor base material. Suitable semiconductor base materials include monocrystalline silicon, polycrystalline silicon, amorphous silicon, silicon-on-insulator, and gallium arsenide. Preferably, the workpiece comprises a metal layer, more preferably a metal layer selected from the group consisting of copper, tungsten, tantalum, platinum, aluminum, and combinations thereof. Even more preferably, the metal layer comprises copper.

The polishing composition that can be used with the polishing pad substrate of the invention typically comprises a liquid carrier (e.g., water) and optionally one or more additives selected from the group consisting of abrasives (e.g., alumina, silica, titania, ceria, zirconia, germania, magnesia, and combinations thereof), oxidizers (e.g., hydrogen peroxide and ammonium persulfate), corrosion inhibitors (e.g., benzotriazole), film-forming agents (e.g., polyacrylic acid and polystyrenesulfonic acid), complexing agents (e.g., mono-, di-, and poly-carboxylic acids, phosphonic acids, and sulfonic acids), pH adjustors (e.g., hydrochloric acid, sulfuric acid, phosphoric acid, sodium hydroxide, potassium hydroxide, and ammonium hydroxide), buffering agents (e.g., phosphate buffers, acetate buffers, and sulfate buffers), surfactants (e.g., nonionic surfactants), salts thereof, and combinations thereof. The selection of the components of the polishing composition depends in part on the type of workpiece being polished.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. Nos. 5,196,353, 5,433,651, 5,609,511, 5,643,046, 5,658,183, 5,730,642, 5,838,447, 5,872,633, 5,893,796, 5,949,927, and 5,964,643. Desirably, the inspection or monitoring of the progress of the polishing process with respect to a workpiece being polished enables the determination of the polishing end-point, i.e., the determination of when to terminate the polishing process with respect to a particular workpiece.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad substrate for use in chemical-mechanical polishing comprising a copolymer, wherein the copolymer has at least one hydrophilic repeat unit and at least one hydrophobic repeat unit, and wherein the polishing pad substrate has a surface energy of about 34 mN/m or less.

2. The polishing pad substrate of claim 1, wherein the hydrophilic repeat unit is selected from the group consisting of esters, ethers, acrylic acids, acrylamides, amides, imides, vinylalcohols, vinylacetates, acrylates, methacrylates, sulfones, urethanes, vinylchlorides, etheretherketones, carbonates, and oligomers and combinations thereof.

3. The polishing pad substrate of claim 1, wherein the hydrophilic repeat unit is urethane.

4. The polishing pad substrate of claim substrate 1, wherein the hydrophobic repeat unit is selected from the group consisting of fluorocarbons, tetrafluoroethylenes, vinylfluorides, siloxanes, dimethylsiloxanes, butadiene, ethylene, olefins, styrene, propylene, and oligomers and combinations thereof.

5. The polishing pad substrate of claim 1, wherein the hydrophobic repeat unit is fluorocarbon or siloxane.

6. The polishing pad substrate of claim 1, wherein the polishing pad substrate is a solid, non-porous polishing pad substrate.

7. The polishing pad substrate of claim 1, wherein the polishing pad substrate has a density of about 90% or more of the maximum theoretical density of the copolymer.

8. The polishing pad substrate of claim 1, wherein the polishing pad substrate is a porous polishing pad substrate.

9. The polishing pad substrate of claim 8, wherein the polishing pad substrate has a density of about 70% or less of the maximum theoretical density of the copolymer.

10. The polishing pad substrate of claim 8, wherein the polishing pad substrate has a void volume of about 75% or less.

11. The polishing pad substrate of claim 1, wherein the polishing pad substrate is a polishing layer.

12. The polishing pad substrate of claim 11, wherein the polishing layer further comprises grooves.

13. The polishing pad substrate of claim 1, wherein the polishing pad substrate is a subpad.

14. The polishing pad substrate of claim 1, wherein the polishing pad substrate further comprises an optically transmissive region.

15. The polishing pad substrate of claim 14, wherein the optically transmissive region has a light transmission of at least 10% at one or more wavelengths between from about 190 nm to about 3500 nm.

16. The polishing pad substrate of claim 14, wherein the optically transmissive region comprises the copolymer.

17. The polishing pad substrate of claim 1, wherein the polishing pad substrate further comprises abrasive particles.

18. The polishing pad substrate of claim 17, wherein the abrasive particles comprise metal oxide selected from the group consisting of alumina, silica, titania, ceria, zirconia, germania, magnesia, co-formed products thereof, and combinations thereof.

19. A polishing pad substrate for use in chemical-mechanical polishing comprising a polymer, wherein the polymer has at least one hydrophilic unit and at least one hydrophobic unit attached to the polymer chain, and wherein the polishing pad substrate has a surface energy of about 34 mN/m or less.

20. The polishing pad substrate of claim 19, wherein the polymer is a thermoplastic polymer or a thermoset polymer.

21. The polishing pad substrate of claim 20, wherein the thermoplastic polymer or the thermoset polymer is selected from the group consisting of polyurethanes, polyolefins, polyvinylalcohols, polyvinylacetates, polycarbonates, polyacrylic acids, polyacrylamides, polyethylenes, polypropylenes, nylons, fluorocarbons, polyesters, polyethers, polyamides, polyimides, polytetrafluoroethylenes, polyetheretherketones, copolymers thereof, and mixtures thereof.

22. The polishing pad substrate of claim 21, wherein the thermoplastic polymer or the thermoset polymer is selected from the group consisting of polyurethanes and polyolefins.

23. The polishing pad substrate of claim 19, wherein the hydrophilic unit is selected from the group consisting of esters, ethers, acrylic acids, acrylamides, amides, imides, vinylalcohols, vinylacetates, acrylates, methacrylates, sulfones, urethanes, vinylchlorides, etheretherketones, carbonates, and oligomers and combinations thereof.

24. The polishing pad substrate of claim 19, wherein the hydrophilic unit is urethane.

25. The polishing pad substrate of claim substrate 19, wherein the hydrophobic unit is selected from the group consisting of fluorocarbons, tetrafluoroethylenes,vinylfluorides, siloxanes, dimethylsiloxanes, butadiene, ethylene, olefins, styrene, propylene, and oligomers and combinations thereof.

26. The polishing pad substrate of claim 19, wherein the hydrophobic unit is fluorocarbon or siloxane.

27. The polishing pad substrate of claim 19, wherein the at least one hydrophilic unit and the at least one hydrophobic unit are attached to a terminal repeat unit of the polymer chain.

28. The polishing pad substrate of claim 19, wherein the polishing pad substrate is a solid, non-porous polishing pad substrate.

29. The polishing pad substrate of claim 19, wherein the polishing pad substrate has a density of about 90% or more of the maximum theoretical density of the copolymer.

30. The polishing pad substrate of claim 19, wherein the polishing pad substrate is a porous polishing pad substrate.

31. The polishing pad substrate of claim 30, wherein the polishing pad substrate has a density of about 70% or less of the maximum theoretical density of the polymer.

32. The polishing pad substrate of claim 30, wherein the polishing pad substrate has a void volume of about 75% or less.

33. The polishing pad substrate of claim 19, wherein the polishing pad substrate is a polishing layer.

34. The polishing pad substrate of claim 33, wherein the polishing layer further comprises grooves.

35. The polishing pad substrate of claim 19, wherein the polishing pad substrate is a subpad.

36. The polishing pad substrate of claim 19, wherein the polishing pad substrate further comprises an optically transmissive region.

37. The polishing pad substrate of claim 36, wherein the optically transmissive region has a light transmission of at least 10% at one or more wavelengths between from about 190 nm to about 3500 nm.

38. The polishing pad substrate of claim 36, wherein the optically transmissive region comprises the polymer having at least one hydrophilic unit and at least one hydrophobic unit attached to the polymer chain.

39. The polishing pad substrate of claim 19, wherein the polishing pad substrate further comprises abrasive particles.

40. The polishing pad substrate of claim 39, wherein the abrasive particles comprise metal oxide selected from the group consisting of alumina, silica, titania, ceria, zirconia, germania, magnesia, co-formed products thereof, and combinations thereof.

* * * * *